US009869137B2

(12) United States Patent
Ahow

(10) Patent No.: US 9,869,137 B2
(45) Date of Patent: Jan. 16, 2018

(54) UNDERGROUND WELL ELECTRICAL CABLE TRANSITION WITH FLOATING PISTON SEAL

(71) Applicant: Hector Guillermo Ahow, Medellin (CO)

(72) Inventor: Hector Guillermo Ahow, Medellin (CO)

( * ) Notice: Subject to any disclaimer, the term of this patent is extended or adjusted under 35 U.S.C. 154(b) by 298 days.

(21) Appl. No.: 14/852,626

(22) Filed: Sep. 14, 2015

(65) Prior Publication Data

US 2017/0074065 A1 Mar. 16, 2017

(51) Int. Cl.
*E21B 17/02* (2006.01)
*E21B 43/12* (2006.01)

(52) U.S. Cl.
CPC ..... *E21B 17/023* (2013.01); *E21B 43/128* (2013.01)

(58) Field of Classification Search
CPC ..... E21B 17/023; E21B 17/028; E21B 43/128
USPC ..... 166/65.1
See application file for complete search history.

(56) References Cited

U.S. PATENT DOCUMENTS 9,388,654 B2 * 7/2016 Urrego Lopera ... E21B 33/0385

* cited by examiner

*Primary Examiner* — Matthew R Buck
*Assistant Examiner* — Patrick Lambe
(74) *Attorney, Agent, or Firm* — E J Asbury III, LLC

(57) ABSTRACT

A penetrator for enabling an electrical cable transition into an underground well. The well has a well casing for containing fluids and pressures from reaching the environment external to the well. The well casing has a wellhead, multiple electrical conductors passing through the penetrator at the wellhead to supply electrical power to down-hole equipment. The wellhead penetrator device provides a reliable sealing solution and which may be quickly installed within wellhead. The penetrator device provides a design which increases the pressure upon the critical sealing surfaces with the electrical conductors as pressure increases within the well casing. The service life of the penetrator seal is maximized to avoid costly downtime to the well operation. The penetrator device is readily installed by maintenance crews and a minimum number of components are utilized. No adhesives or sealants are required in the installation.

16 Claims, 8 Drawing Sheets

UNDERGROUND WELL ELECTRICAL CABLE TRANSITION WITH FLOATING PISTON SEAL

BACKGROUND OF THE INVENTION

1. Field of the Invention

The present invention generally relates to an electrical cable transition, and seal for an underground well, and more particularly, to a simple and effective wellhead electrical cable penetration through the well casing which blocks fluid and pressure flow to and from the well and eliminates any cable splices in the well.

2. Description of the Related Art

In underground wells such as oil wells, the well opening is enclosed using a well casing. The well casing seals gasses and other fluids within the well from being released into the outside environment. Equipment within the well casing is often referred to as "down-hole" within the art. Electrical power is furnished to submersible pumps and other down-hole equipment through insulated electrical conductors that extend through conduit in the well casing. In order to connect the down-hole equipment to a power source outside the well, these conductors must penetrate a wellhead barrier that is sealed to a top opening of the casing. This configuration of cables and seals in the wellhead is called a "penetrator," the purpose for which is to provide a transition zone where the cable penetrates the wellhead barrier. The penetrator seal prevents pressure, gas and other fluids from leaking both into and out of the well past the well casing. In most wellhead designs, a hanger is used within the well head to support down-hole piping and is the component through which the penetrator assembly passes. As used herein, the term hanger is considered to be a component positioned within the wellhead from which down-piping is suspended. The penetrator may pass through the hangar, or through another portion of the wellhead.

Because the down-hole equipment must be connected to an above-ground power source, a splice or other connection must be formed between cable connected to the power source and cable extending upward from the down-hole equipment. This splice has been formed below the wellhead barrier in the past, which isolates the splice from the area around the outside of the wellhead barrier which is classified as a hazardous location. It is however desirable to perform the electrical splice above the wellhead barrier. Where the splice is outside the wellhead barrier, new power and control electronics can be readily connected to the down-hole equipment. A reliable penetrator seal around electrical lines leading up from the down-hole equipment is required.

An electrical connection within the oil well pumping system with the electro-submersible or electro-progressive cavity pump, is required for its operation. A power cable of bundled electrical conductors supplies the electrical current from a workstation controller at the surface toward the pump that is located within the well. Most common is a three-phase power cable, that is to say, consisting of three strands of electrical conductors transmitting both the electrical current, and the ability to control the operation of the pump, including the speed and rotational direction, through variation of frequencies of the electrical current. In the extreme operating environment within the well casing and the outside environment, the conductive lines carry certain special protections; a galvanized steel frame that provides a mechanical protection, a lead jacket for waterproofing each line, and a rubber isolation or ethylene propylenediene EPDM (Ethylene Propylene Diene M ASTM type) to electrically isolate each copper conductor. For this reason, the penetrator must provide a hermetic seal efficient, to isolate the internal atmosphere within the well casing with the atmosphere of the surface, this is to avoid leaks and contamination to the environment.

Currently common in the industry are two types or configurations of cable to pass through the penetrator. First, a round type that positions each line to 120°, and second a flat type which configures the three drivers in a flat configuration. It should be noted that in the round cable lead the jacket is replaced by a plastic cover and additionally has a sheathing of nitrile.

According, what is needed in the art is a wellhead penetrator device that presents a reliable sealing solution and which may be quickly installed within wellhead. Time is a very expensive variable in the production of oil and other natural resources from a well. During penetrator replacement, the well production must be stopped, the above ground electrical power disconnected, and the wellhead removed while a new penetrator is installed. The installation time must be as short and efficient as possible, and the seal integrity and service life of the penetrator must be maximized. To ease the installation of the penetrator device by maintenance crews, a minimum number of components is desirable, and the penetrator design should not require the use of adhesives or sealants. The penetrator seal must also be highly reliable under varying pressures within the well casing. It is thus to such underground well electrical penetrator with floating seal that the present invention is primarily directed.

SUMMARY OF THE INVENTION

The disadvantages of the prior art are overcome by the present invention which, in one aspect, is a penetrator forming an electrical cable transition into an underground well. The well has a well casing for containing fluids and pressures from reaching the environment external to the well. The well casing has a wellhead, and a plurality of electrical conductors passing through the penetrator at the wellhead to supply electrical power to down-hole equipment.

An upper mandrel, generally configured as an elongate hollow tube with a first end, and a second end. The upper mandrel having a stepped internal bore at the first end thereof, the outermost first diameter bore adjacent the first end forming a smooth cylindrical internal bore. The adjacent second diameter of the stepped bore forming an internal thread. And a third diameter bore forming a smooth cylindrical internal bore.

A lower mandrel, generally configured as an elongate hollow tube with a first end, and a second end. The lower mandrel has a smooth cylindrical internal bore at the first end thereof. The opposing outer surface of the first end of the lower mandrel forming an external thread. The external thread of the lower mandrel configured to engage the internal thread of the upper mandrel. A seat, generally configured as a cylindrical disk comprising an upper surface and a lower surface. The seat has a plurality of cylindrical bores passing through the body of the disk from the upper surface to the lower surface.

A plurality of seals generally configured as a cylinder with a tapered outer diameter and having an upper end and a lower end. Each seal has a larger outer diameter at the upper end than the lower end. Each seal further comprising a cylindrical bore passing through the seal body from the upper end to the lower end. A piston, generally configured as a cylindrical disk comprising an upper surface and a lower surface. The piston has a plurality of tapered bores passing through the body of the disk from the upper surface to the lower surface. Each of the plurality of tapered bores has a larger inner diameter at the upper end than the lower end.

The plurality of electrical conductors pass through the interior of the lower mandrel, each of the plurality of electrical conductors pass through one of the tapered bores of the piston, each of the plurality of electrical conductors pass through one of the cylindrical bores of a seal, and each of the plurality of electrical conductors pass through one of the cylindrical bores of the seat, and then the plurality of the electrical conductors pass through the interior of the upper mandrel.

Wherein the external thread of the lower mandrel is engaged with the internal thread of the upper mandrel, and the seat is received within the a third diameter bore at the first end of the upper mandrel, the piston is received within internal bore at the first end of the lower mandrel, and each seal of the plurality of seals is driven into a tapered bore of the piston. And upon further engagement of the external thread of the lower mandrel with the internal thread of the upper mandrel by tightening the treaded connection, the tapered outer diameter of each seal is compressed into the tapered inner diameter of each piston bore. Each seal is compressed up into contact with the lower surface of the seat. And each seal is compressed around an outer surface of the electrical conductor passing through each seal. The penetrator thereby forming a first fluid and pressure seal between the electrical conductors, seals, and piston.

In another aspect of the present invention, pressure at the second end of the lower mandrel drives the piston towards the upper mandrel, increasing the compression of each of the plurality of seals against the piston and seat, and increasing the compression of each of the plurality of seals against each electrical conductor, thereby increasing the effectiveness of the first fluid and pressure seal of the penetrator.

In another aspect of the present invention, a plurality of cylindrical protrusion extend down from the lower surface of the seat, each cylindrical protrusion concentric with each of the plurality of cylindrical bores, and each of the cylindrical bore passing through each seat from the upper surface, through the seat body, and through the cylindrical protrusion. And the upper end of each seal has a counter bore concentric with the through bore and configured to receive a cylindrical protrusions of the seat therein. And wherein as the threaded connection between the upper and lower mandrel is tightened, each cylindrical protrusion of the seat is driven into a counter bore of a seal.

In another aspect of the present invention, a second fluid and pressure seal is formed between the lower mandrel and the upper mandrel when the threaded connection is engaged. Wherein the outer cylindrical surface of the lower mandrel has an O-ring groove at a location opposing the first diameter bore of the upper mandrel when the threaded connection is engaged, and the second fluid and pressure seal is formed by an O-ring positioned within the O-ring groove, and wherein upon insertion of the lower mandrel within the upper mandrel, the O-ring is compressed between the upper mandrel and lower mandrel.

In another aspect of the present invention, a third fluid and pressure seal is formed between the piston and the lower mandrel. The outer cylindrical surface of the piston comprises at least one O-ring groove, and the third fluid and pressure seal is formed by an O-ring positioned within the O-ring groove. Wherein upon insertion of the piston within the lower mandrel, the O-ring is compressed between the piston and lower mandrel.

In another aspect of the present invention, a fourth fluid and pressure seal is formed between the upper mandrel and the wellhead when the upper mandrel is affixed within the wellhead. The upper mandrel has an O-ring grove in the outer cylindrical surface of the upper mandrel, and the fourth fluid and pressure seal is formed by an O-ring positioned within the O-ring groove. Wherein upon insertion of the upper mandrel within the wellhead, the O-ring is compressed between the upper mandrel and the wellhead.

In other aspects of the present invention, the seals are molded from at least one of: a natural rubber, a synthetic rubber, a fluoropolymer elastomer, or any combination thereof. The seals are molded from nitrile rubber. The seat is made of engineering thermoplastic within the class of polymers known as polyoxymethylene. The seat is made of at least one of: acetal copolymer, acetal, polyacetal, polyformaldehyde, or any combination thereof.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

The wellhead penetrator device of the present invention provides a reliable sealing solution and which may be quickly installed within wellhead. The service life of the penetrator seal is maximized to avoid costly downtime to the well operation. The penetrator device is readily installed by maintenance crews, and a minimum number of components are utilized. No adhesives or sealants are required in the installation. The penetrator device provides a design which increases the pressure upon the critical sealing surfaces with the electrical conductors as pressure increases within the well casing.

Figure 1:
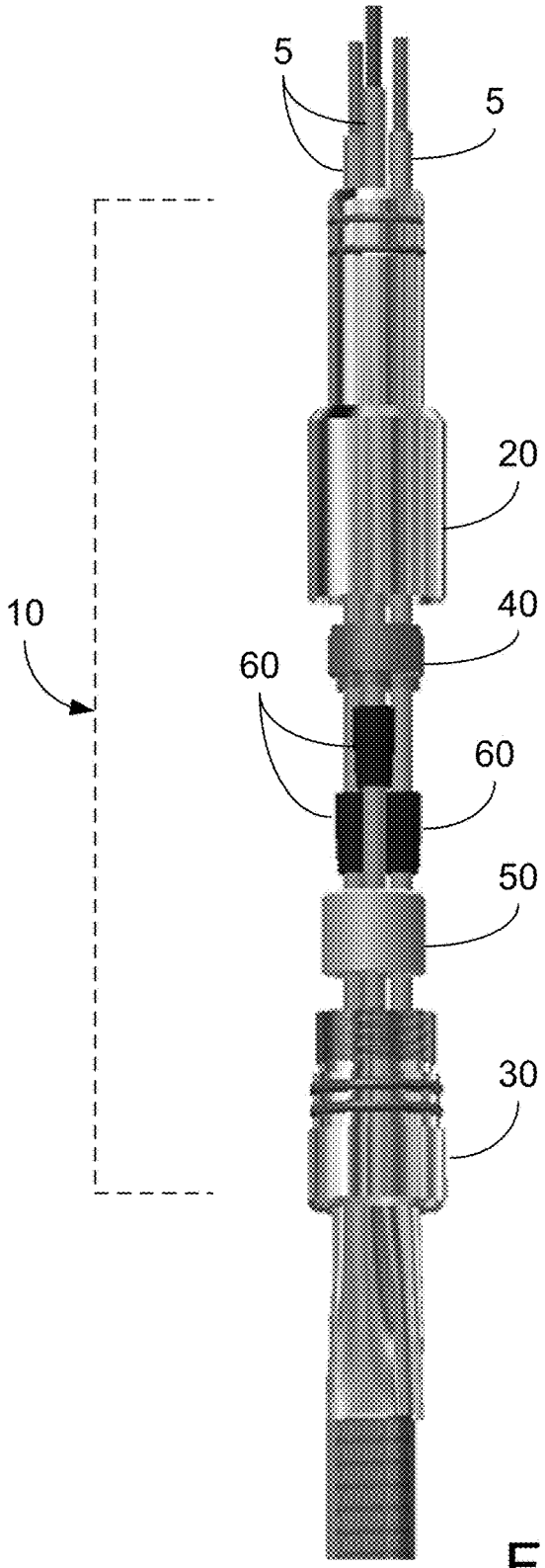
FIG. 1 is a rear side exploded view showing the components of the penetrator device, and engaging with electrical conductors.

With reference to the figures in which like numerals represent like elements throughout, FIG. 1 is a side view of one embodiment of the wellhead penetrator device. As depicted in FIG. 1, the penetrator device 10 uses a two piece main housing with an upper mandrel 20, and a lower mandrel 30. The penetrator device 10 also incorporates a seat 40, a piston 50, and a plurality of seals 60. In the depiction of FIG. 1, three (3) electrical conductors 5 are shown passing thru the penetrator device. The use of three conductors is a common configuration as most down-hole equipment is supplied using 3 phase electrical power. As will be appreciated by those skilled in the art, alternative embodiments of the penetrator device 10 may be readily configured for one, two, or four conductors. More than four conductors may also be sealed by an appropriately configured penetrator device in special situations. As used herein, the hanger is considered a component of the wellhead. The penetrator positioned within the wellhead refers to the penetrator positioned within the hangar, or within another component of the wellhead assembly.

Figure 2:
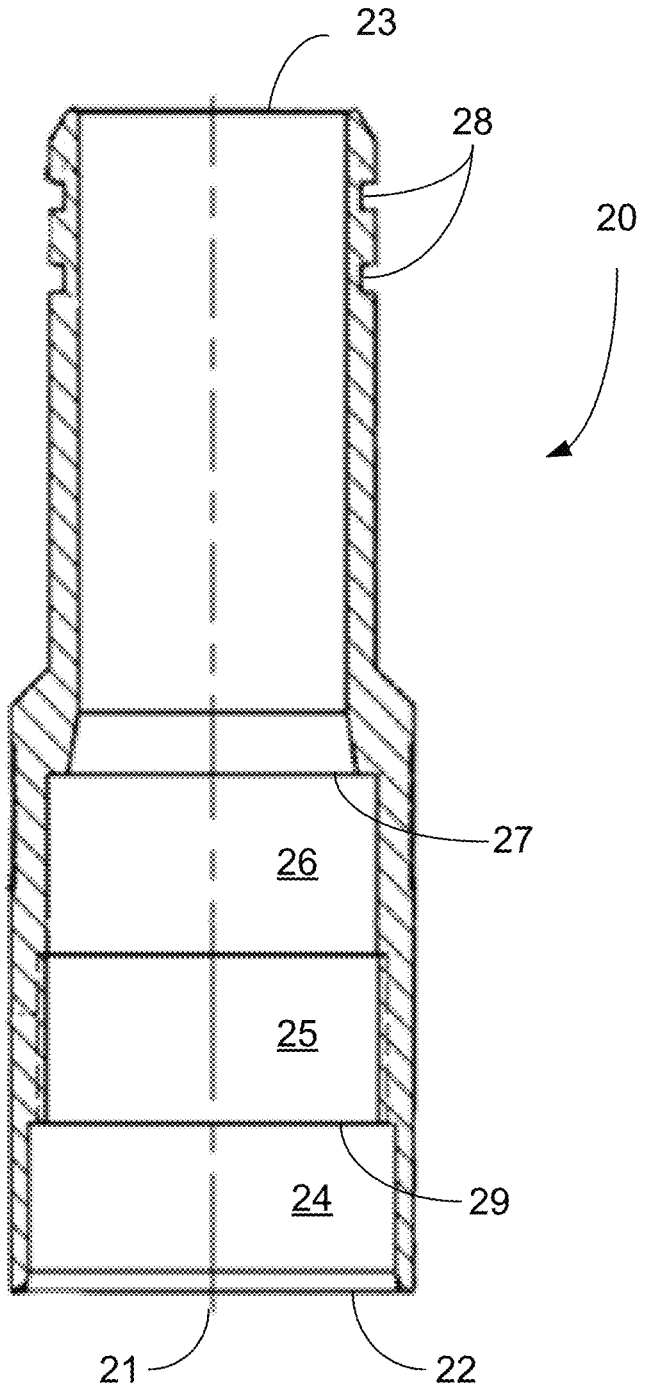
FIG. 2 is a cross-sectional view showing the upper mandrel of the device.

The upper mandrel 20 is a generally hollow tubular shape having a central axis and incorporating varying inner diameters, internal threads within the bore, varying outer diameters and sealing features on the exterior surface. FIG. 2 is a cross-section view through the central axis 21 of the upper mandrel 20. The upper mandrel 20 has a lower end 22, and upper end 23. At the lower end 22 of the upper mandrel 20, are a series of decreasing diameter internal bores which are concentric with central axis 21. The largest internal bore 24, has a smooth interior surface and is utilized as an O-ring sealing surface when mated with the lower mandrel 30. The internal bore 24 terminates in a reduced diameter step 29. The adjacent internal bore 25, is a smaller diameter and is threaded to engage complimentary threads on the lower mandrel 30. The innermost internal bore 26 has a smooth interior surface and terminates in a step 27. The diameter of the internal bore 26 is configured to accept a sliding fit with the seat 40. At the upper end 23 of the upper mandrel 20, groves 28 are formed on the exterior surface and are configured to accept sealing O-rings. The upper mandrel 20 is a solid of revolution and may be readily and efficiently fabricated by lathe turning and threading operations as are known in the art.

Figure 3A:
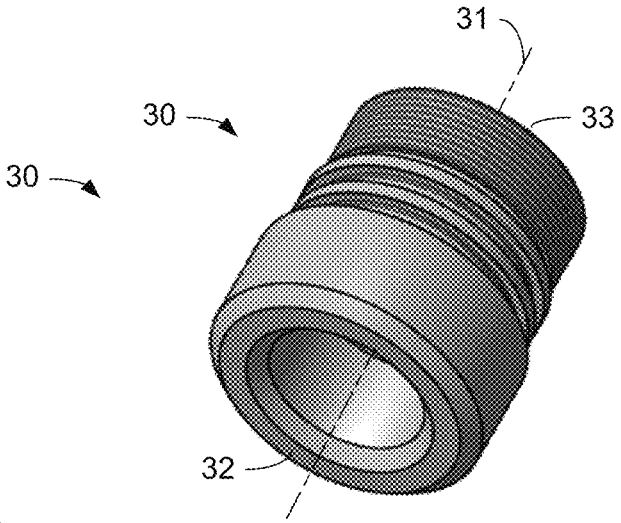
FIG. 3A is a bottom-side perspective view of the lower mandrel of the device.

FIG. 3A is a bottom-side perspective view of the lower mandrel 30. As depicted in FIG. 3A, the lower mandrel 30 is a generally hollow tubular shape having a central axis 31 and incorporating varying inner diameters within the bore, and varying outer diameters, exterior threads, and sealing features on the exterior surface. The lower mandrel 30 has a lower end 32, and upper end 33.

Figure 3B:
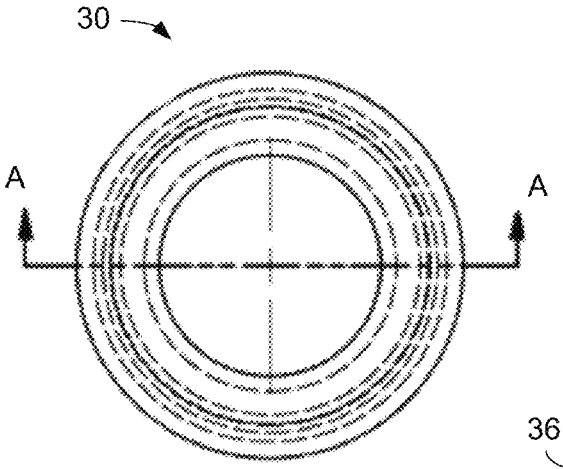
FIG. 3B is a bottom view of the lower mandrel.
Figure 3C:
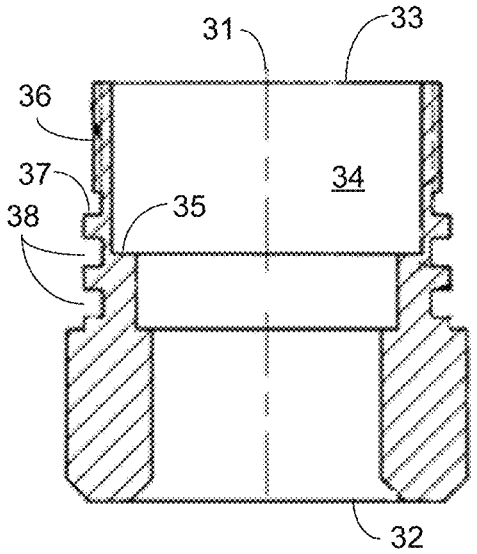
FIG. 3C is a cross-sectional view of the lower mandrel of FIG. 3B.

FIG. 3B is a bottom view of the lower end 32 of the lower mandrel 30. The varying internal and external diameters of the lower mandrel 30 are depicted as solid and hidden lines. The location of a cross section "A-A" through the central axis 31 is also depicted. FIG. 3C is cross-sectional view "A-A" of the lower mandrel 30. As depicted in FIG. 3C, the upper end 33 of the lower mandrel 30 has an internal bore 34. The internal bore 34 has a smooth interior surface and is utilized as an O-ring sealing surface when mated with the piston 50. The internal bore 34 terminates in a reduced diameter step 35.

The exterior of the upper end 33 of the lower mandrel 30 is threaded to engage complimentary threads within the upper mandrel 20. An increased diameter step 37 is formed at the termination of the threaded section 36. At the mid body of the lower mandrel 30, groves 38 are formed on the exterior surface and are configured to accept sealing O-rings. The lower mandrel 20 is a solid of revolution and may be readily and efficiently fabricated by lathe turning and threading operations as are known in the art. In one embodiment of the present invention, the upper mandrel 20 and lower mandrel 30 are machined from 304 stainless steel material.

Figure 4A:
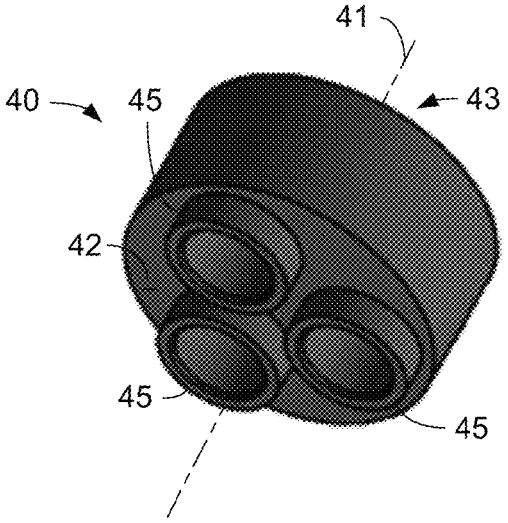
FIG. 4A is a bottom-side perspective view of the seat of the device.
Figure 4B:
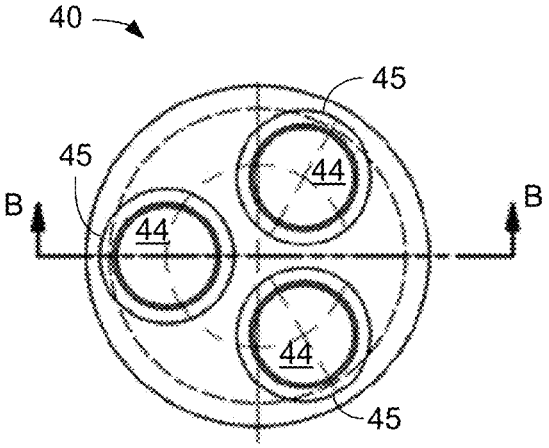
FIG. 4B is a bottom view of the seat.

FIG. 4A is a bottom-side perspective view of the seat 40. As depicted in FIG. 4A, seat 40 is a generally disk shape having a central axis 41. The seat 40 has a lower surface 42, and an upper surface 43. Three (3) cylindrical protrusions 45 extend out from the lower surface 42, and are parallel with, offset from, and equally spaced about the central axis 41. FIG. 4B is a bottom view of the lower surface 42 of the seat 40. As depicted in FIG. 4B, three (3) constant diameter through bores 44 are centered on each cylindrical protrusion 45 and pass through the cylindrical protrusions 45 and the body of the seat 40 to the upper surface 43. The location of a cross-section "B-B" through the central axis 41 is also depicted.

Figure 4C:
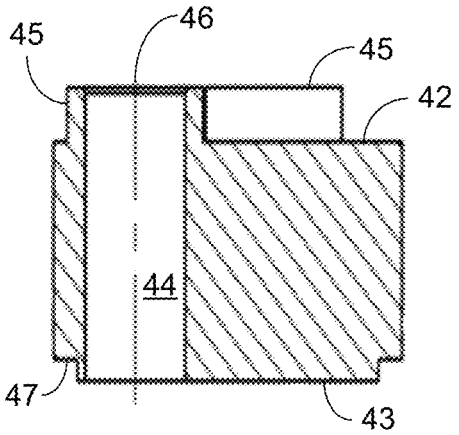
FIG. 4C is a cross-sectional view of the seat of FIG. 4B.

FIG. 4C is cross-sectional view "B-B" of the seat 40, with hidden lines omitted. As depicted in FIG. 4A-C, the through bores 44 pass from the upper surface 43 of the seat 40, through the body of the seat and pass through the cylindrical protrusions 45. The axis 46 of the constant diameter bores 44 is parallel with the central axis 41 of the seat 40. A step 47 is formed by a reduced diameter portion of the upper surface 43. In one embodiment of the present invention, the seat 40 is formed or machined from acetal copolymer. As will be appreciated by those skilled in the art, other types of engineering thermoplastic may be used within the class of polymers known as polyoxymethylene or (POM), such as acetal, polyacetal and polyformaldehyde.

Figure 5A:
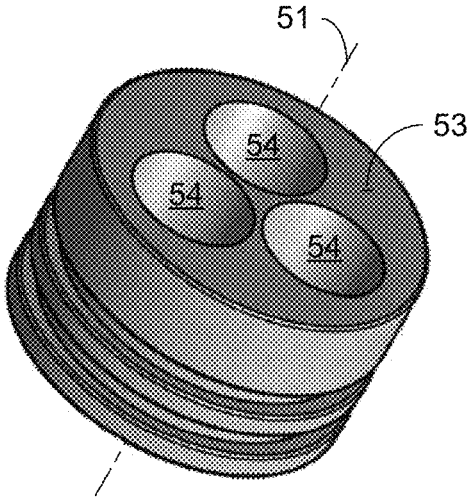
FIG. 5A is a top-side perspective view of the piston of the device.
Figure 5B:
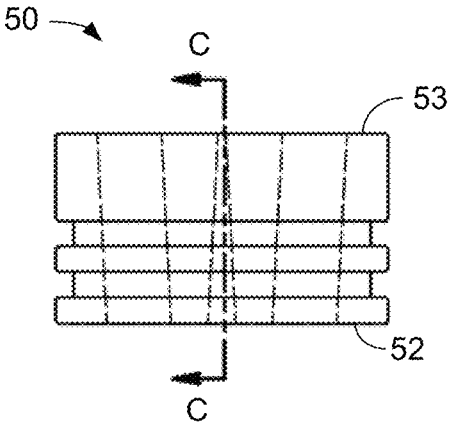
FIG. 5B is a side view of the piston.

FIG. 5A is a top-side perspective view of the piston 50. As depicted in FIG. 5A, piston 50 is a generally disk shape having a central axis 51. The piston 50 has a lower surface 52, and an upper surface 53. Three (3) tapered bores 54 pass through the body of the piston 50 and are offset from and equally spaced about the central axis 51. FIG. 5B is a side view of the piston 50. The location of a cross section "C-C" through the central axis 51 of the piston 50 is depicted.

Figure 5C:
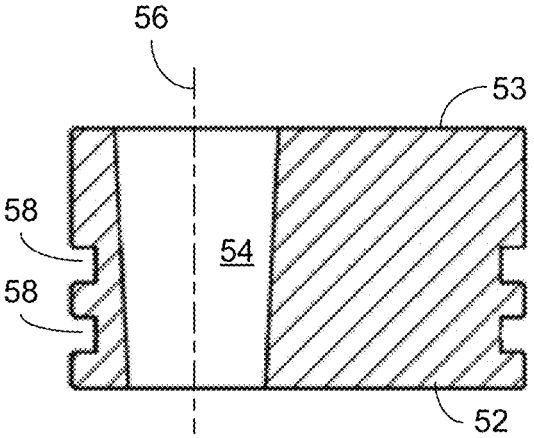
FIG. 5C is a cross-sectional view of the piston of FIG. 5B.

FIG. 5C is cross-sectional view "C-C" of the piston 50, with hidden lines omitted. As depicted in FIG. 5C, the tapered bores 54 pass from the upper surface 53 to the lower surface 52 of the piston 50. The central axis 56 of the tapered bores 54 is parallel with and offset from the central axis 51 of the piston 50. The offset and spacing of the tapered bores 54 of the piston 50 matches the offset and spacing of the through bores 44 of the seat 40, wherein the central axis 56 of the tapered bores aligns with the central axis 46 of each through bore when the penetrator is assembled. The diameter of the tapered bore 54 is larger at the upper surface 53 than that at the lower surface 52. On the outer circumference of the piston 50, groves 58 are formed on the exterior surface and are configured to accept sealing O-rings. In one embodiment of the present invention, the piston is machined from 304 stainless steel material.

Figure 6A:
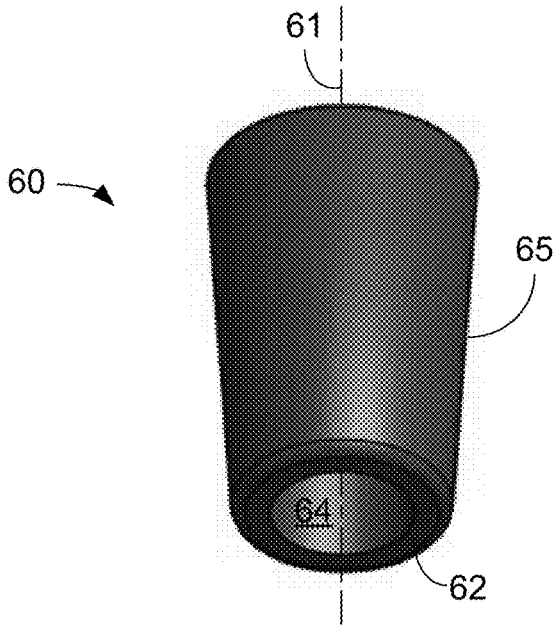
FIG. 6A is a bottom-side perspective view of a seat of the device.
Figure 6B:
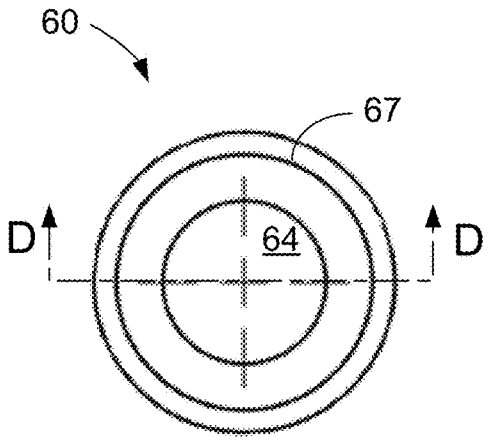
FIG. 6B is a top view of the seat.

FIG. 6A is a bottom-side perspective view of a seal 60. As depicted in FIG. 6A, the external surface 65 of seal 60 is a tapered cylinder having a central axis 61. The seal 60 has a lower surface 62, and an upper surface 63. FIG. 6B is a top view of the seal 60. A straight bore 64 passes through the body of the seal 60 from the lower surface 62 to the upper surface 63 along the central axis 61. The location of a cross section "D-D" through the central axis 61 of the seal 60 is also depicted.

Figure 6C:
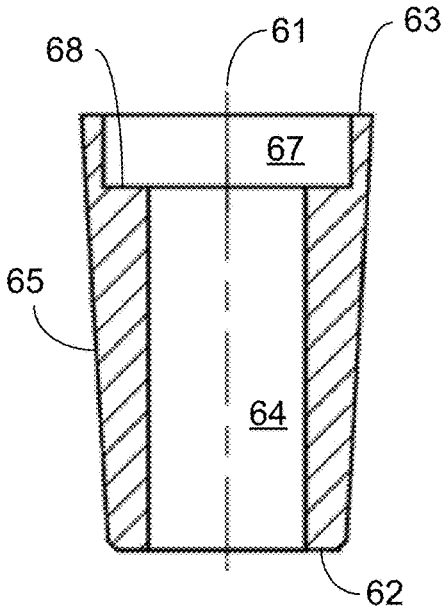
FIG. 6C is a cross-sectional view of the seat of FIG. 6B.

FIG. 6C is cross-sectional view "D-D" of the seal 60. As depicted in FIG. 4C, a counter-bore 67 is formed in the seal 60 at the top surface 63 and concentric with the central axis 61. The bottom surface 68 of the counter-bore 67 forms a step. The counter-bore 67 is sized to tightly engage cylindrical protrusions 45 of the seat 69. The diameter of the outer surface 65 of the seal 60 is larger at the upper surface 63 than that at the lower surface 62, thus forming a tapered cylindrical shape of the outer surface 60.

As depicted in FIGS. 5C and 6C, the tapered bores 54 and seals 60 have a straight taper along the axil length of the bore and seal when viewed in cross-section. As will be appreciated by those skilled in the art, other taper shapes may be used such as elliptical, parabolic, hyperbolic, stepped, or any combination thereof.

In one embodiment of the present invention, the seal 60 is molded from nitrile rubber. As will be appreciated by those skilled in the art, in alternative embodiments other types of natural rubber, synthetic rubber and fluoropolymer elastomer may be used.

Figure 7:
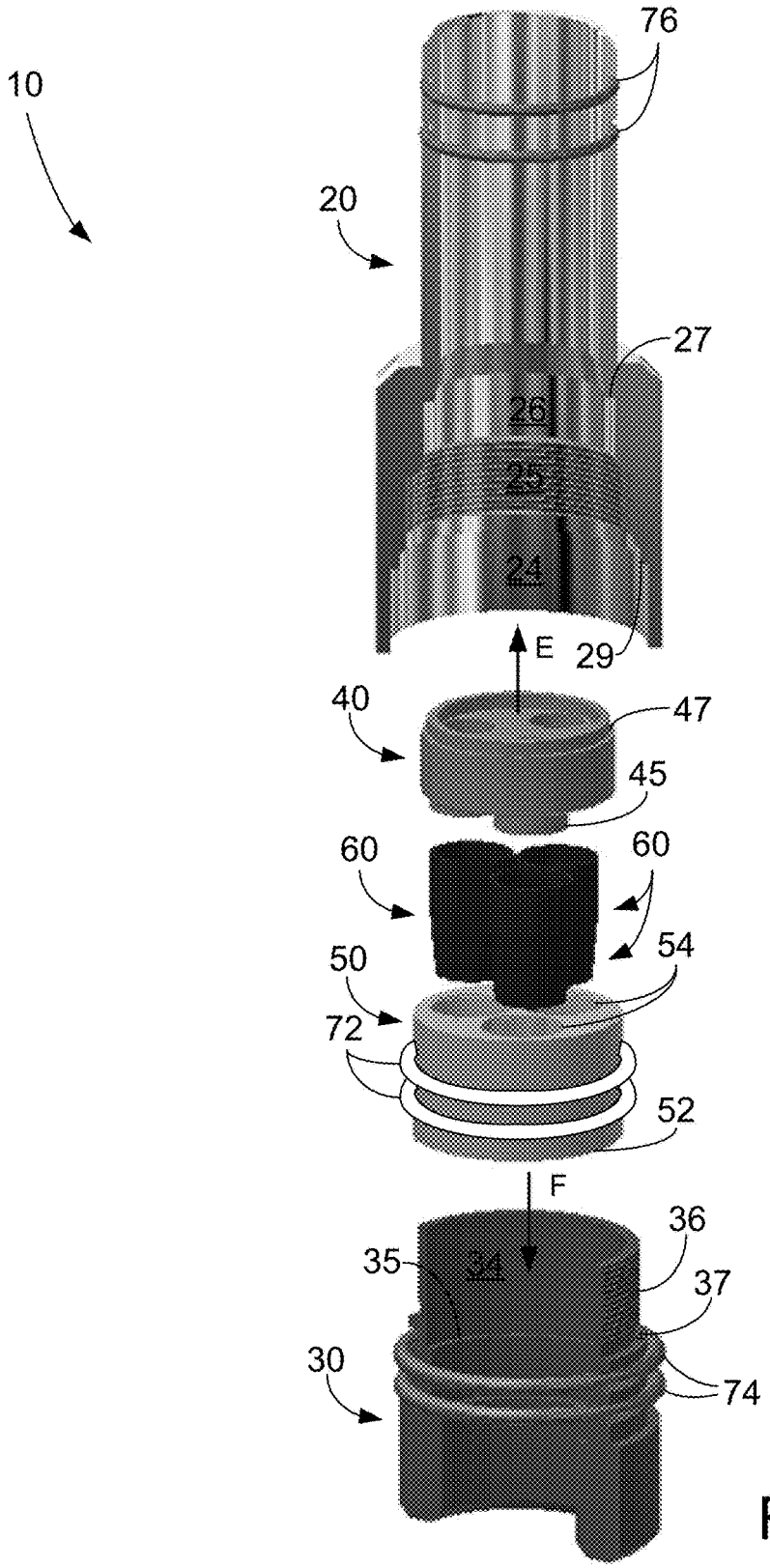
FIG. 7 is a partial cross-sectional view of the components of the device.

FIG. 7 depicts an exploded view of the penetrator device. To install the device within the well casing, O-rings 72 are installed upon the piston 50 and positioned within the grooves 58. O-rings 74 are installed upon the lower mandrel 30 and positioned within the grooves 38. And O-rings 76 are installed upon the upper mandrel 20 and positioned within the groves 28.

To prepare for penetrator installation, the power cable of bundled electrical conductors leading up from the down-hole equipment is prepared by removing the galvanized steel frame and lead jacket from the conductors at the location on the power cable where the penetrator is to be installed. In the case of round bundled electrical conductors, the plastic cover and nitrile sheathing are removed. The conductors are separated with the rubber isolation or ethylene propylene-diene EPDM sheathing of each conductor intact.

At assembly of the penetrator 10 within the well casing, all electrical conductors from the down-hole equipment are inserted thru the lower mandrel 50. Each electrical conductor is passed through one of the tapered bores in the piston 50, through one of the seals 60, and through one of the bores in the seat 40. The process is repeated for the remaining electrical conductors. All electrical conductors are then inserted through the upper mandrel 20.

In assembling the penetrator, the seat 40 is inserted within and engages with the bore 26 of the upper mandrel 20 in the direction of Arrow "E". The seat 40 bottoms out in the assembly when the step 47 in the upper surface 43 of the seat is driven into contact with the step 27 in the bore 26. The seat 40 is a sliding fit within the bore 26 and is free to rotate within the bore. The piston 50 is inserted within the bore 34 of the lower mandrel 30 in the direction of Arrow "F". The piston bottoms out in the assembly when the bottom surface 52 of the piston contacts the step 35 in the lower mandrel. O-rings 72 form a fluid and pressure seal between the piston 50 and the lower mandrel 30 while allowing the piston 50 to rotate and translate within the bore 34.

Figure 8:
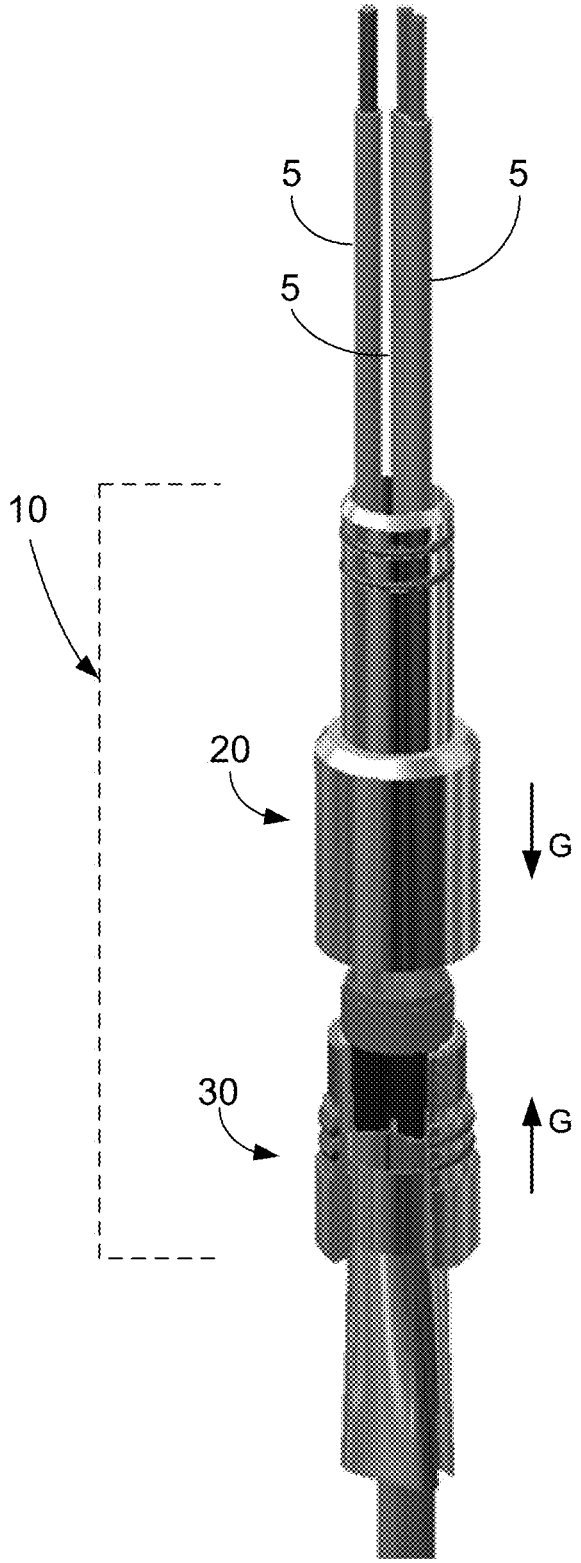
FIG. 8 is a partial cross-sectional view of the components of the device engaging electrical conductors.

As depicted in FIGS. 7-8, the external threads 36 of the lower mandrel 30 may then be engaged with the internal threads 25 of the upper mandrel 20. As the lower mandrel 30 is tighten onto the upper mandrel, the piston, seals, and seat are driven into contact in the direction of Arrows "G". Each seal 60 mates within a tapered bore 54 of the piston 50. Mating sealing surfaces are thereby engaged between the tapered cylindrical exterior surface of the seal 60 and the tapered bore 54 of the piston 50. The upper surface 63 of the seal 60 is driven into contact with the lower surface 42 of the seat 40, and the cylindrical protrusions 45 of the seat 40 are driven into the counter-bore 67 of the seal 60. The outer face of the cylindrical protrusions 45 are also driven into surface 68 of seal counter-bore 67. The interior bore 64 of each seal 60 is compressed around the electrical conductor as the tapered seal is being driven into the tapered bore 54. The combination of sealing surfaces above, effectively seals fluid and pressure form the well casing from passing around the electrical cables 5, through the penetrator 10 and into the outside environment.

As the lower mandrel 30 is tighten onto the upper mandrel, O-rings 74 engage bore 24 within the upper mandrel 20 and form a fluid and pressure seal between the upper mandrel 20 and lower mandrel 30. When the lower mandrel 30 is fully tightened within the upper mandrel 20, step 37 on the lower mandrel contacts step 29 of the upper mandrel and prevents further thread engagement. The design of the step 37 contacting the step 29 mechanically limits the amount of compression or pre-load upon the penetrator seals 60. The manufacturing tolerances of the penetrator components: upper mandrel 20, lower mandrel 30, piston 50, seals 60, and seat 40 allow a reliable and predetermined compression of the seals 60 around the electrical conductors 5 in the assembled penetrator device 10 suitable for normal operating conditions and pressures within the well casing.

In another embodiment of the present invention, the piston 50 is free to axially translate upward within the bore 34 of the lower mandrel 30. As pressure increases within the well casing, the pressure urges the piston 50 upward within the bore 34 in the direction opposing Arrow "F" of FIG. 7 and along the central axis 31 of the lower mandrel 30. The upward movement of the piston 50 forces the seals 60 into tighter contact with the piston 50, seat 40, and electrical conductors 5. Stated another way, the internal pressure within the well casing may float the piston off of the step 35 and further compress the seals 60. In the case of over-pressurization within the well casing, the design of the present invention actually increases the compression exerted upon the seals 60, thus maintaining the integrity of the penetrator 10 seal.

The use of O-rings 72 on the piston 50 allows the piston to rotate within the lower mandrel 30. The sliding/rotating fit of the seat 40 within the upper mandrel 20, allows the seat 40 to rotate within the upper mandrel 20. The ability to rotate the lower mandrel 30 without rotating the piston 50, seals 60, or seat 40 allows the lower mandrel to be screwed into the upper mandrel without unwanted twisting of the electrical conductors within the penetrator 10 or damage to any of the sealing surfaces. The critical sealing surfaces between the tapered bores 54 of the piston 50, seals 60, seat 40, and the electrical conductors 5, experience only axial movement as the penetrator is assembled and the sealing surfaces are driven, or compressed, together.

As will be appreciated by those skilled in the art, alternative embodiments of the penetrator device 10 may be readily configured for one, two, or four conductors. In each alternative embodiment, the piston 50 will have tapered bores 54 and seat 40 will have through and cylindrical protrusions 44, 45 equal to the number of conductors to be passed through the penetrator. Seals 60 equal to the number of conductors and will engage each of the conductors.

In installing the assembled penetrator 10 within the wellhead, the upper mandrel 20 of the penetrator 10 affixed within the wellhead, and O-rings 76 form a fluid and pressure seal between the upper mandrel and the wellhead. The penetrator may pass through the hangar, or may pass through another component of the wellhead assembly.

While there has been shown a preferred embodiment of the present invention, it is to be understood that certain changes may be made in the forms and arrangement of the elements of the penetrator device without departing from the underlying spirit and scope of the invention.

What is claimed is:

1. A penetrator forming an electrical cable transition into an underground well, the well having a well casing for containing fluids and pressures from reaching the environment external to the well, the well casing having a wellhead, and a plurality of electrical conductors passing through the penetrator at the wellhead to supply electrical power to down-hole equipment, the penetrator comprising:

an upper mandrel, generally configured as an elongate hollow tube comprising a first end, and a second end, the upper mandrel comprising a stepped internal bore at the first end thereof, the outermost first diameter bore adjacent the first end forming a smooth cylindrical internal bore, the adjacent second diameter of the stepped bore forming an internal thread, and a third diameter bore forming a smooth cylindrical internal bore;

a lower mandrel, generally configured as an elongate hollow tube comprising a first end, and a second end, the lower mandrel comprising a smooth cylindrical internal bore at the first end thereof, and the opposing outer surface of the first end forming an external thread;

the external thread of the lower mandrel configured to engage the internal thread of the upper mandrel;

a seat, generally configured as a cylindrical disk comprising an upper surface and a lower surface, the seat comprising a plurality of cylindrical bores passing through the body of the disk from the upper surface to the lower surface;

a plurality of seals, each seal generally configured as a cylinder with a tapered outer diameter, the seal comprising an upper end and a lower end, the seal comprising a larger outer diameter at the upper end than the lower end, each seal further comprising a cylindrical bore passing through the seal body from the upper end to the lower end;

a piston, generally configured as a cylindrical disk comprising an upper surface and a lower surface, the piston comprising a plurality of tapered bores passing through the body of the disk from the upper surface to the lower surface, each of the plurality of tapered bores has a larger inner diameter at the upper end than the lower end;

wherein the plurality of electrical conductors pass through the interior of the lower mandrel, each of the plurality of electrical conductors pass through one of the tapered bores of the piston, each of the plurality of electrical conductors pass through one of the cylindrical bores of a seal, and each of the plurality of electrical conductors pass through one of the cylindrical bores of the seat, and the plurality of the electrical conductors pass through the interior of the upper mandrell;

wherein the external thread of the lower mandrel is engaged with the internal thread of the upper mandrel, the seat is received within the a third diameter bore at the first end of the upper mandrel, the piston is received within internal bore at the first end of the lower mandrel, and each seal of the plurality of seals is driven into a tapered bore of the piston; and wherein upon further engagement of the external thread of the lower mandrel with the internal thread of the upper mandrel by tightening the treaded connection, the tapered outer diameter of each seal is compressed into the tapered inner diameter of each piston bore, each seal is compressed up into contact with the lower surface of the seat, and each seal is compressed around an outer surface of the electrical conductor passing through each seal, the penetrator thereby forming a first fluid and pressure seal between the electrical conductors, seals, and piston.

2. The penetrator of claim 1, wherein pressure at the second end of the lower mandrel drives the piston towards the upper mandrel, increasing the compression of each of the plurality of seals against the piston and seat, and increasing the compression of each of the plurality of seals against each electrical conductors, thereby increasing the effectiveness of the first fluid and pressure seal of the penetrator.

3. The penetrator of claim 1, further comprising a plurality of cylindrical protrusion extending down from the lower surface of the seat, each cylindrical protrusion concentric with each of the plurality of cylindrical bores, and each of the cylindrical bore passing through each seat from the upper surface, through the seat body, and through the cylindrical protrusion.

4. The penetrator of claim 3, wherein the upper end of each seal has a counter bore concentric with the through bore and configured to receive a cylindrical protrusions of the seat therein; and wherein as the threaded connection between the upper and lower mandrel is tightened, each cylindrical protrusion of the seat is driven into a counter bore of a seal.

5. The penetrator of claim 1, wherein a second fluid and pressure seal is formed between the lower mandrel and the upper mandrel when the threaded connection is engaged.

6. The penetrator of claim 5, wherein the outer cylindrical surface of the lower mandrel comprises at least one O-ring groove at a location opposing the first diameter bore of the upper mandrel when the threaded connection is engaged, the second fluid and pressure seal is formed by an at least one O-ring positioned within the at least one O-ring groove, and wherein upon insertion of the lower mandrel within the upper mandrel, the O-ring is compressed between the upper mandrel and lower mandrel.

7. The penetrator of claim 1, wherein a third fluid and pressure seal is formed between the piston and the lower mandrel.

8. The penetrator of claim 7, wherein the outer cylindrical surface of the piston comprises at least one O-ring groove, the third fluid and pressure seal is formed by an at least one O-ring positioned within the at least one O-ring groove, and wherein upon insertion of the piston within the lower mandrel, the O-ring is compressed between the piston and lower mandrel.

9. The penetrator of claim 1, wherein a fourth fluid and pressure seal is formed between the upper mandrel and the wellhead when the upper mandrel is affixed within the wellhead.

10. The penetrator of claim 9, wherein the upper mandrel comprises at least one O-ring grove in the outer cylindrical surface of the upper mandrel, and the fourth fluid and pressure seal is formed by an at least one O-ring positioned within the at least one O-ring groove, and wherein upon insertion of the upper mandrel within the wellhead, the O-ring is compressed between the upper mandrel and the wellhead.

11. The penetrator of claim 1, wherein a second fluid and pressure seal is formed between the lower mandrel and the upper mandrel when the threaded connection is engaged, a third fluid and pressure seal is formed between the piston and the lower mandrel upon insertion of the piston within the mandrel, a fourth fluid and pressure seal is formed between the upper mandrel and the wellhead when the upper mandrel is affixed within the wellhead; and wherein the combination of the first, second, third, and fourth fluid and pressure seals of the penetrator form a fluid and pressure seal between the interior of the well casing and the external environment.

12. The penetrator of claim 1, wherein the seals are comprised of at least one of: a natural rubber, a synthetic rubber, a fluoropolymer elastomer, or any combination thereof.

13. The penetrator of claim 12, wherein the seals is comprised of nitrile rubber.

14. The penetrator of claim 1, wherein the seat is comprised of engineering thermoplastic within the class of polymers known as polyoxymethylene.

15. The penetrator of claim 14, wherein the seat is comprised of acetal copolymer.

16. The penetrator of claim 14, wherein the seat is comprised of at least one of: acetal, polyacetal, polyformaldehyde, or any combination thereof.

* * * * *